United States Patent [19]

Manschwetus

[11] Patent Number: 4,867,382

[45] Date of Patent: Sep. 19, 1989

[54] LIFTING MECHANISM FOR THE PRESSING ROLLER OF THE FEED MECHANISM OF A CRUSHER FOR SCRAP

[75] Inventor: Helmut Manschwetus, Fuldabrück, Fed. Rep. of Germany

[73] Assignee: Thyssen Industrie AG, Essen, Fed. Rep. of Germany

[21] Appl. No.: 252,264

[22] Filed: Sep. 30, 1988

[30] Foreign Application Priority Data

Oct. 16, 1987 [DE] Fed. Rep. of Germany ..... 3734999

[51] Int. Cl.[4] ..... B02C 23/02

[52] U.S. Cl. ..... 241/101.2; 241/186 R; 241/280; 241/285 A; 241/285 B

[58] Field of Search ..... 241/101.2, 186 R, 186.2, 241/189 R, 189 A, 222, 245, 280, 285 A, 285 B, 285 R, 290

[56] References Cited

U.S. PATENT DOCUMENTS

| | | | |
|---|---|---|---|
| 3,462,088 | 8/1969 | Ionescu | 241/290 X |
| 3,545,690 | 12/1970 | Burian et al. | 241/285 B X |
| 4,718,614 | 1/1988 | Häusler et al. | 241/189 R |

FOREIGN PATENT DOCUMENTS 3301186 9/1983 Fed. Rep. of Germany .

*Primary Examiner*—Joseph M. Gorski

*Attorney, Agent, or Firm*—Becker & Becker, Inc.

[57] ABSTRACT

A lifting mechanism for the pressing roller of the feed mechanism of a crusher for scrap. The rotor of the crusher, via a lifting mechanism that acts upon a mounting bracket of the rotor mounting, can be removed from a split housing after an upper part of the housing has been raised about a horizontal pivot axis and has been secured in position relative to a lower part of the housing, whereby pivot arms are disposed on opposite faces of the housing and are connected to hydraulic cylinders, with free ends of the pivot arms being pivotably mounted about a horizontal axis, and with the pivot arms being successively connected with the upper housing part to raise the same, with the mounting bracket after the upper housing part is secured relative to the lower housing part in an open position and the pivot arms have again been lowered, and again with the upper part after the rotor is removed. The pivot arms are extended beyond the contour of the housing toward the feed mechanism and are respective side arms of a U-shaped frame. The free ends of the side arms are disposed remote from the feed mechanism and are pivotably mounted, about a horizontal axis that is substantially aligned with the pivot axis between the upper and lower parts of the housing, on supports that are disposed next to the opposite faces of the housing without touching the same, and that are securely connected to a base.

1 Claim, 9 Drawing Sheets

6b
4
II
I
14
1a
5a
1
5
13
2
3

LIFTING MECHANISM FOR THE PRESSING ROLLER OF THE FEED MECHANISM OF A CRUSHER FOR SCRAP

BACKGROUND OF THE INVENTION

The present invention relates to a lifting mechanism for the pressing roller of the feed mechanism of a crusher for scrap. The rotor of the crusher, via a lifting mechanism that acts upon a mounting bracket of the rotor mounting, can be removed from a split housing after an upper part of the housing has been raised about a horizontal pivot axis and has been secured in position relative to a lower part of the housing. Pivot arms are disposed on opposite faces of the housing and are connected to hydraulic cylinders, with free ends of the pivot arms being pivotably mounted about a horizontal pivot axis that extends parallel to the pivot axis between the upper and lower parts of the housing. The pivot arms, via appropriate pins, are successively connected to the upper part of the housing to raise the same, with the mounting bracket after the upper part of the housing is secured relative to the lower part of the housing in an open position and the pivot arms have again been lowered, and, after the rotor has been removed, again with the upper part of the housing.

With such crushers for scrap, it is necessary to have lifting mechanisms for maintenance operations on the housing and the rotor, and lifting mechanisms for the pressing rollers disposed in the feed mechanism.

A lifting mechanism is known for maintenance operations on a crusher that has a two-part raisable machine housing, the plane of separation of which between the lower and upper parts of the housing extends through the center of the rotor axis.

A respective pivot arm is mounted on both sides of the upper part of the housing, and is actuated by a hydraulic cylinder.

The pivot arms are provided with securing and coupling means, with the use of which it is possible to successively raise the upper part of the housing, to remove the rotor together with its mounting from the lower part of the housing, and to subsequently secure the rotor in the raised position to the raised upper part of the housing (U.S. Pat. No. 4,718,614, which belongs to the assignee of the present application).

Also known is a pressing roller/lifting mechanism, where two pressing rollers are successively arranged in a support frame, the swivel joint of which is disposed on that side remote from the crusher (German Offenlegungsschrift 33 01 186). The purpose of the pressing rollers is to precompress the scrap that is to be crushed, and to control the supply of the scrap. To fulfill these functions, the pressing rollers are driven, and their height is adjustable. To adjust the height of the pressing rollers, a support frame is provided that is pivotably mounted on the feed mechanism, and is customarily actuated by double-acting hydraulic cylinders.

A drawback of such heretofore known crushers is that a large number of hydraulic components, such as hydraulic cylinders and control valves, are necessary for actuating the pressing roller/lifting mechanism and for the lifting mechanism for maintenance operations; the hydraulic components of the lifting mechanism for maintenance operations, although they are connected for only a very short period of time, are subjected to a great standstill wear due to the vibrations and shocks that constantly occur during operation of the crusher.

It is an object of the present invention to improve a lifting mechanism of the aforementioned general type in such a way that the total number of lifting mechanisms required for the operation of a crusher having a feed mechanism is reduced, while at the same time the operational reliability of the remaining hydraulic components is increased.

BRIEF DESCRIPTION OF THE DRAWING

This object, and other objects and advantages of the present invention, will appear more clearly from the following specification in conjunction with the accompanying schematic drawings, in which.

SUMMARY OF THE INVENTION

Figure 1:
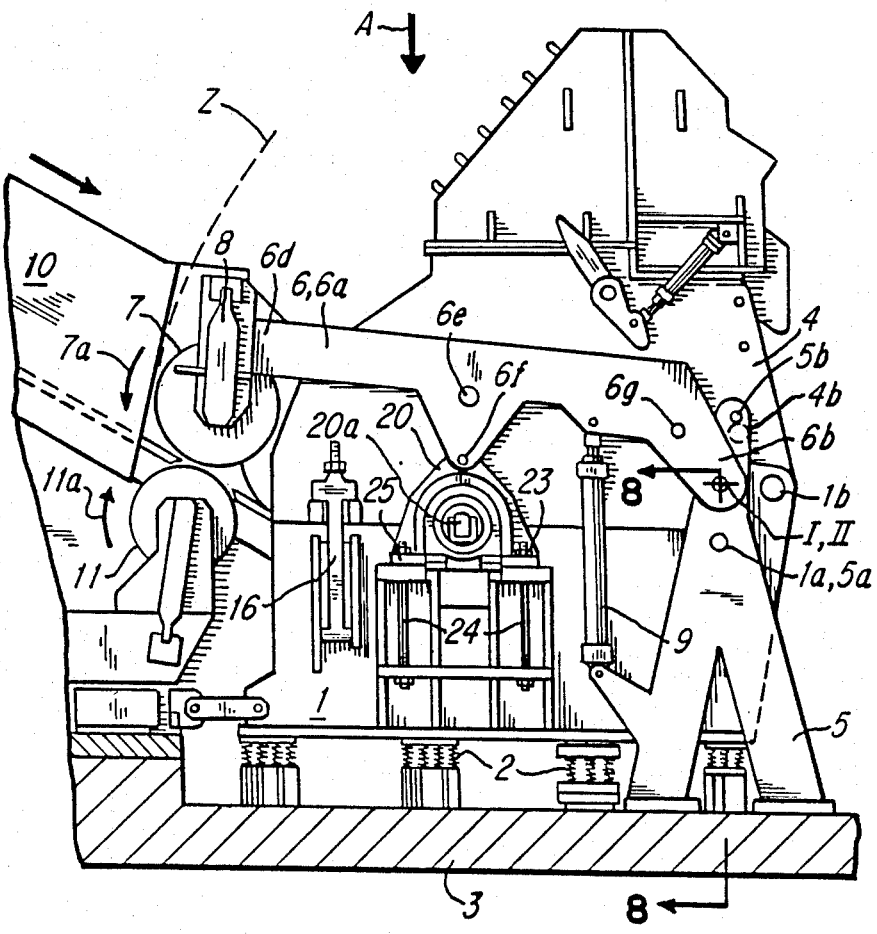
FIG. 1 is a side view of one exemplary embodiment of the inventive lifting mechanism for the pressing roller of the feed mechanism of a crusher for scrap, with the feed or pressing roller in the lowermost operation position.

The lifting mechanism of the present invention is characterized primarily in that the pivot arms are extended beyond the contour of the housing in the direction toward the feed mechanism and are respective side arms of a U-shaped frame having a crosspiece with an underside that supports mounting means of the pressing roller, with the free ends of the pivot arms or side arms being disposed remote from the feed mechanism and being pivotably mounted, about a horizontal pivot axis that is substantially aligned with the pivot axis between the upper and lower parts of the housing, on supports that are respectively disposed next to the opposite faces of the housing, which is resiliently mounted, without touching the same, and that are securely connected with a base for the crusher; the U-shaped frame is adapted to successively carry out the following functions:

(a) raising and lowering of the pressing roller of the feed mechanism with the housing closed, the crusher operating, and the housing not locked in position on the supports;

(b) raising of the upper part of the housing by positively arresting the lower part of said housing relative to the supports via first pins accompanied by alignment of the pivot axis of the U-shaped frame with the pivot axis between the upper and lower parts of the housing, connecting the side arms via second pins to the upper part of the housing, raising the upper part of the housing by activating the hydraulic cylinders, and, in this raised position, arresting the upper part of the housing relative to the lower part of the housing via third pins; and (c) removing of the rotor by releasing the second pins, subsequently pivoting the side arms and positively connecting the same via fourth pins with the mounting bracket of the rotor mounting, raising the side arms by activating the hydraulic cylinders, and in this raised position of the side arms and the rotor, positively connecting the side arms with the supports via fifth pins.

The advantages achieved with the present invention consist in particular in that not only to carry out the lifting movements of the pressing roller during operation of the crusher, but also the lifting operations necessary for the maintenance operations during raising of the housing and removal of the rotor, it is now necessary to have only a single lifting mechanism, and, in place of a large number of hydraulic components, only a single hydraulic cylinder pair with a control slide valve.

The remaining structural elements and hydraulic components, while fulfilling the functions of: (a) raising and lowering the pressing roller, b) raising the upper part of the housing, and (c) removing the rotor, have on the whole a greater duration of operation than the drive of the crusher, and are no longer subjected to standstill wear, on the one hand due to the constantly active hydraulic action, and on the other hand due to their connection to the stationary supports or columns.

Furthermore, an advantage over the known construction of German Offenlegungsschrift 33 01 186 is that during the upward movement out of the lowermost position and into the uppermost position, the pressing roller no longer pushes the incoming scrap back.

Further specific features of the present invention will be described in detail subsequently.

DESCRIPTION OF PREFERRED EMBODIMENTS

Figure 2:
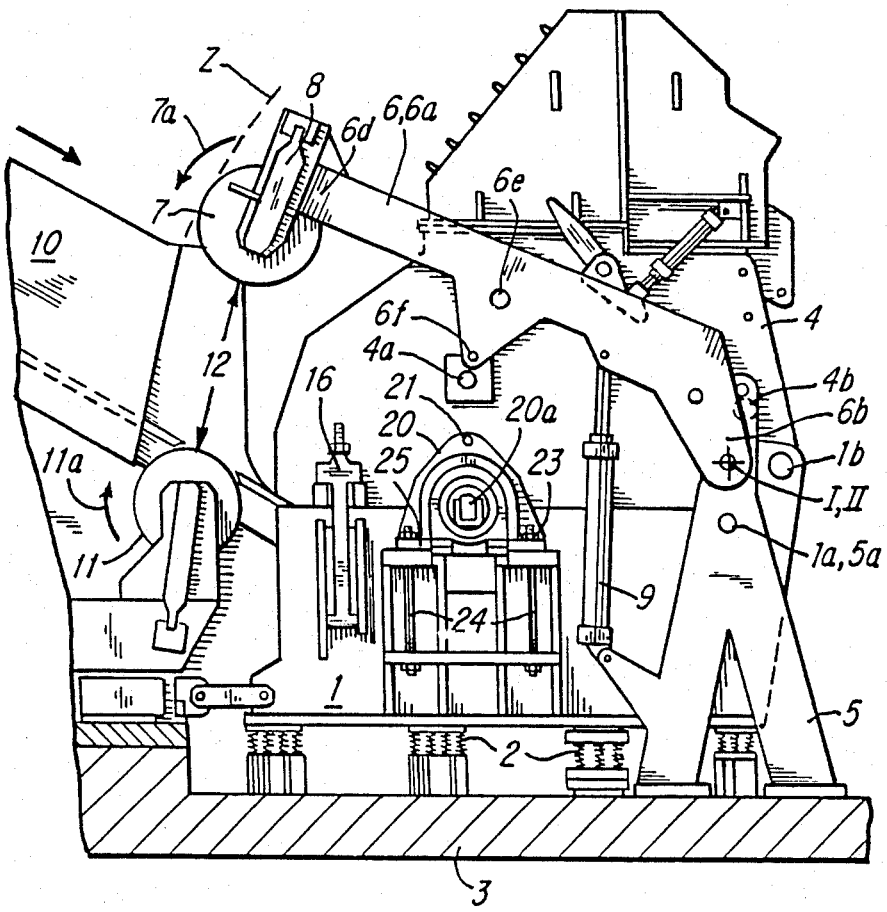
FIG. 2 is a side view similar to that of FIG. 1, but with the feed roller in the uppermost operating position.
Figure 7:
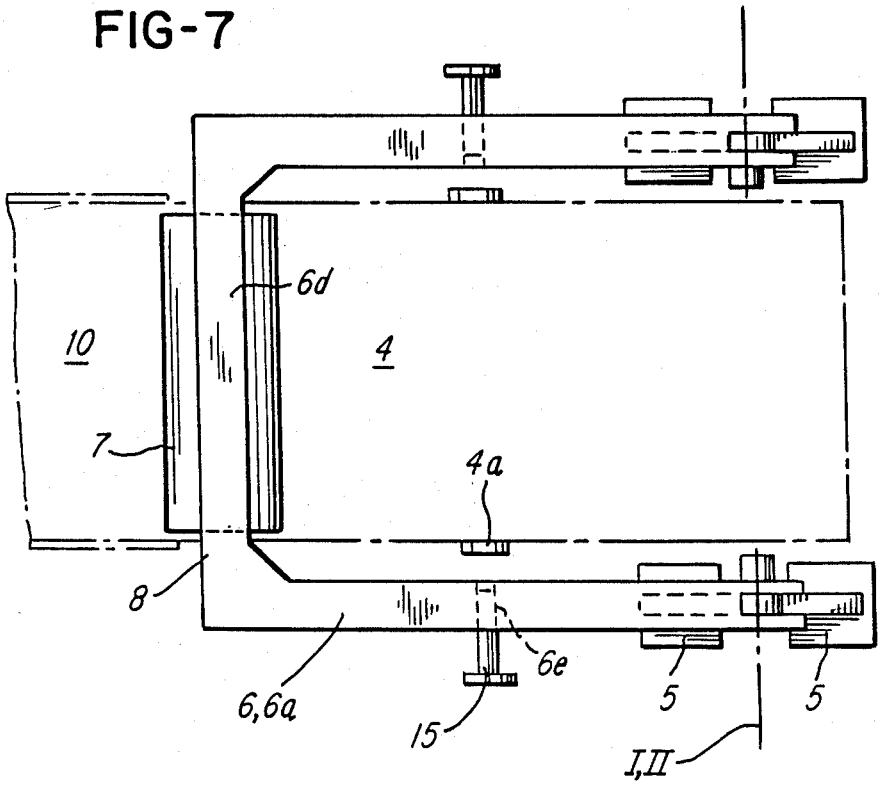
FIG. 7 is a view of the U-shaped frame taken in the direction of the arrow A in FIG. 1.

Referring now to the drawings in detail, in the crusher for scrap or similar material illustrated in the side view of FIG. 1, the lower part 1 of the housing is secured to the base 3 via springs 2. The upper part 4 of the housing can be raised relative to the lower part 1 of the housing about the pivot shaft or axis I. At both faces of the housing, which comprises the lower part 1 and the upper 4, a respective support 5 is secured to the base 3. The free ends **6*b* of the side arms 6*a* of the U-shaped frame 6 are mounted on the supports 5 in such a way as to be pivotable about the pivot shaft or axis II. FIG. 7 shows the U-shaped frame 6 in a simplified view from above. Via mountings 8, the pressing roller 7 is secured to the underside of the crosspiece 6*d* of the U-shaped frame 6. Via hydraulic cylinders 9, which are pivotably secured on the one hand to the supports 5 and on the other hand to the underside of the side arms 6*a*, the U-shaped frame 6 is pivoted about the pivot axis II during operation of the crusher, and hence the pressing roller 7 is raised and lowered. In FIG. 1, the pressing roller 7 is disposed in the lowermost operating position, for example for feeding sheet-metal scrap. In FIG. 2, the pressing roller 7 is disposed in the uppermost operating position, for example for feeding bulky scrap. By raising the pressing roller 7 about the pivot axis II, bulky material located in the feed chute 10 is not pushed back. The outer movement range of the pressing roller 7 is the circular arc portion Z in FIGS. 1 and 2**.

In the illustrated embodiment, disposed at the bottom of the feed chute 10, which extends downwardly at an angle, is a roller 11, the direction of rotation **11*a* of which is opposite to the direction of rotation 7*a* of the pressing roller 7 disposed thereabove. In the uppermost operating position, a maximum passage height 12 exists between the pressing roller 7 and the oppositely disposed roller 11 (see FIG. 2**).

Figure 8:
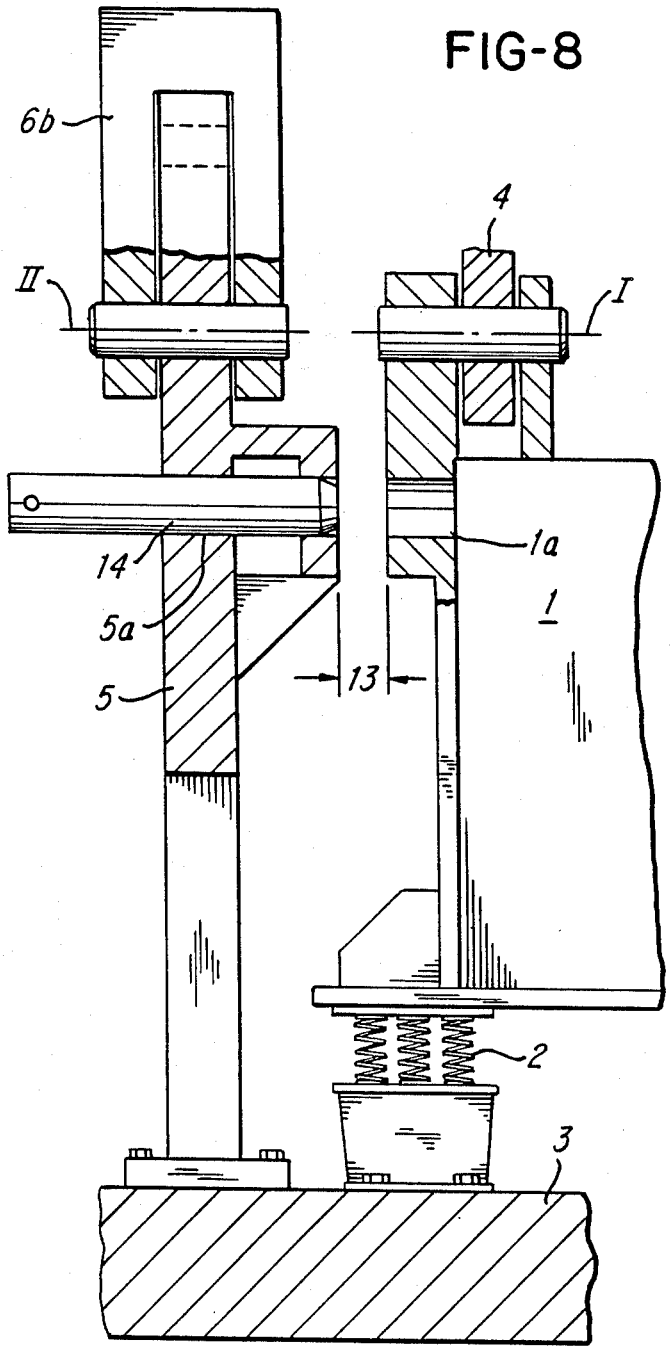
FIG. 8 is a cross-sectional view in the non-arrested position and is taken along the line 8—8 in FIG. 1.

As illustrated in FIG. 8, a respective free space in the form of a gap 13 exists between the supports 5 and the end faces of the housing, which comprises the lower part 1 and the upper part 4. In this way, the housing can oscillate in an unobstructed manner in the vertical direction on its springs 2, whereas the pressing roller 7 of the U-shaped frame 6, which is secured to the support 5, is not influenced by these oscillations.

Figure 3:
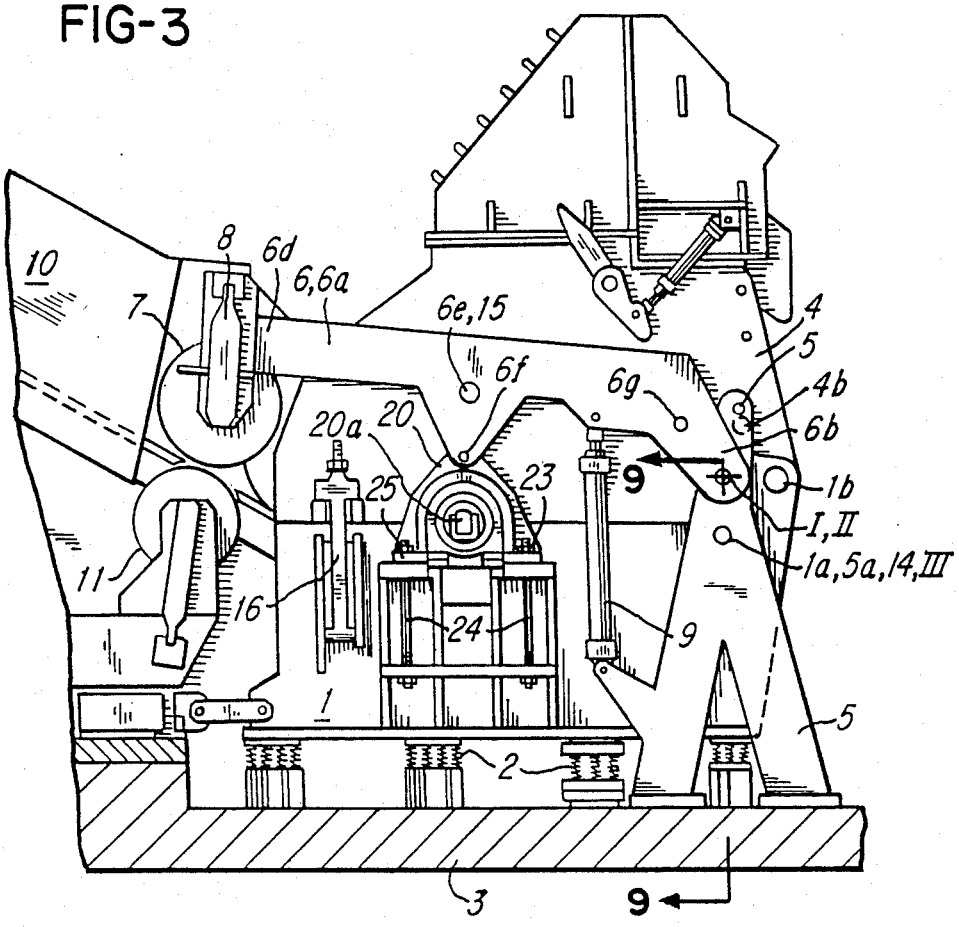
FIG. 3 is a side view similar to that of FIG. 1 in an arrested position ready to raise the upper part of the housing.
Figure 9:
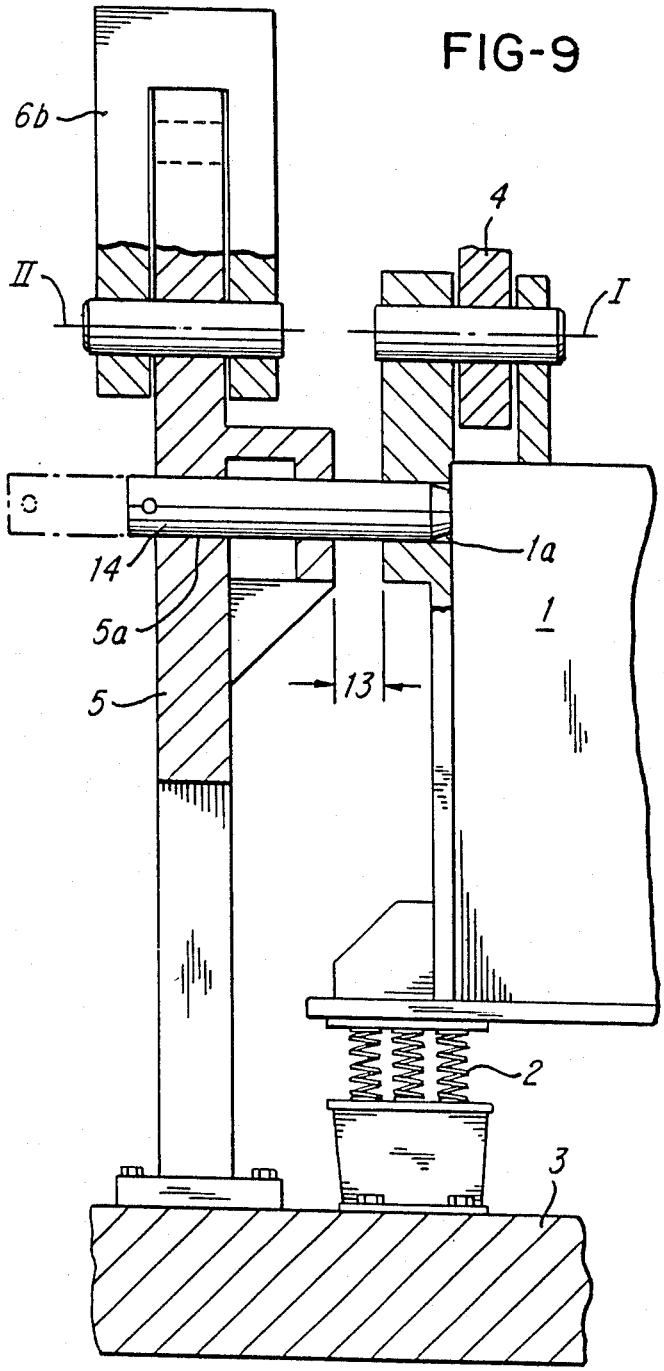
FIG. 9 is a cross-sectional view in the arrested state and is taken along the line 9—9 in FIG. 3.

To raise the upper part 4 of the housing, the possibility of movement between the housing and the supports 5 is eliminated by pins 14 that are horizontally guided in openings **5*a* in the supports 5, and that are inserted into corresponding openings 1*a* in the end faces of the lower part 1 of the housing. FIG. 9 illustrates the arrested state. With this positive connection between the lower part 1 of the housing and the supports 5, the pivot axes I and II are aligned. In FIG. 3**, this arrested state is indicated by the reference symbol III.

Figure 4:
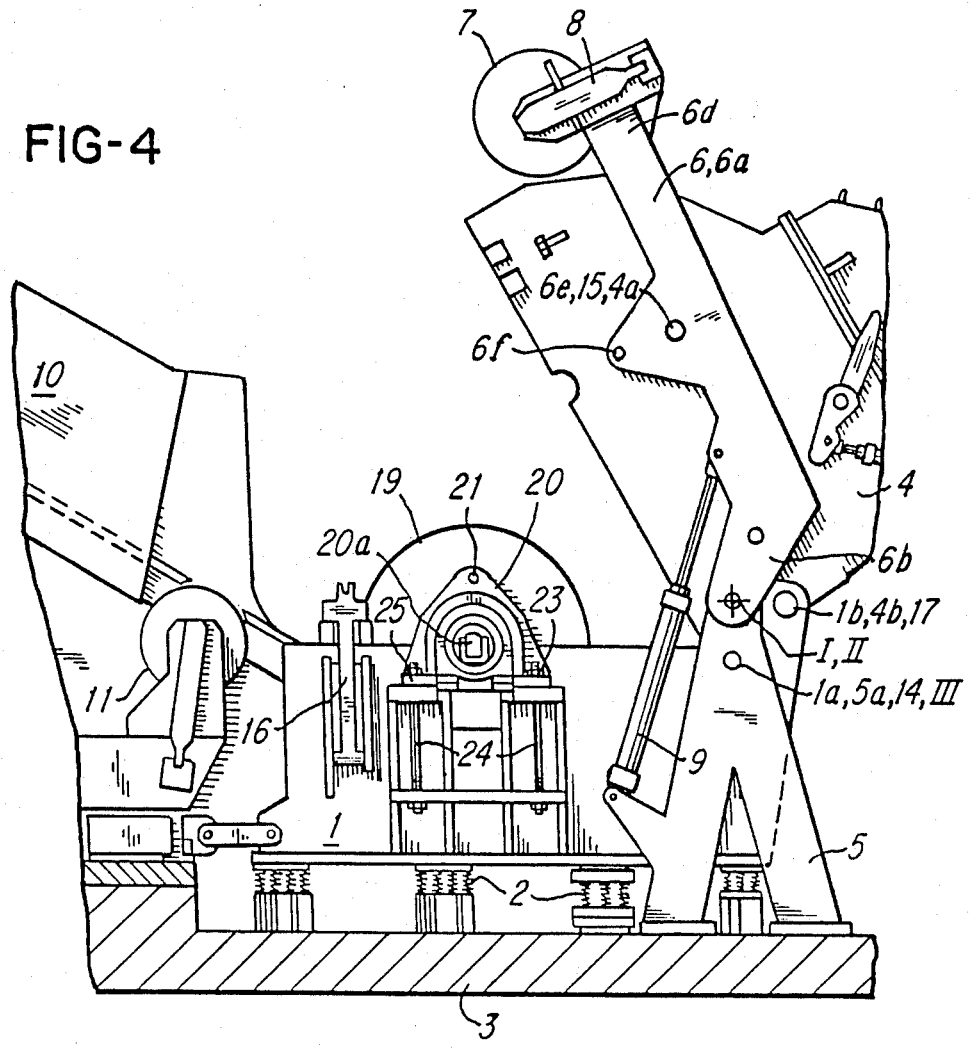
FIG. 4 is a side view similar to FIG. 1, with the upper part of the housing raised and secured in position relative to the lower part of the housing.

To raise the upper part 4 of the housing, the U-shaped frame 6, which is disposed in the lowermost operating position, is positively connected to the upper part 4 via pins 15. For this purpose, the pins 15, which are guided in openings **6*e* of the side arms 6*a*, are introduced into respective openings 4*a* of the upper part 4, whereby in this position the openings 4*a* are in alignment with the openings 6*e*. After releasing the securing mechanism 16, via which the upper part 4 and the lower part 1 are securely clamped together for the operating position, the hydraulic cylinders 9 are activated and the upper part 4 is raised about the pivot axis I to such an extent that the horizontally disposed openings 4*b* in the upper part 4 and 1*b* in the rear member of the lower part 1 are aligned with one another. In this position, a pin 17 is introduced into the openings 4*b* and 1*b* from each side of the housing, as a result of which the upper part 4 is positively secured to the lower part 1 in the raised position. The raised and secured position of the upper part 4 of the housing is illustrated in FIG. 4**.

Figure 5:
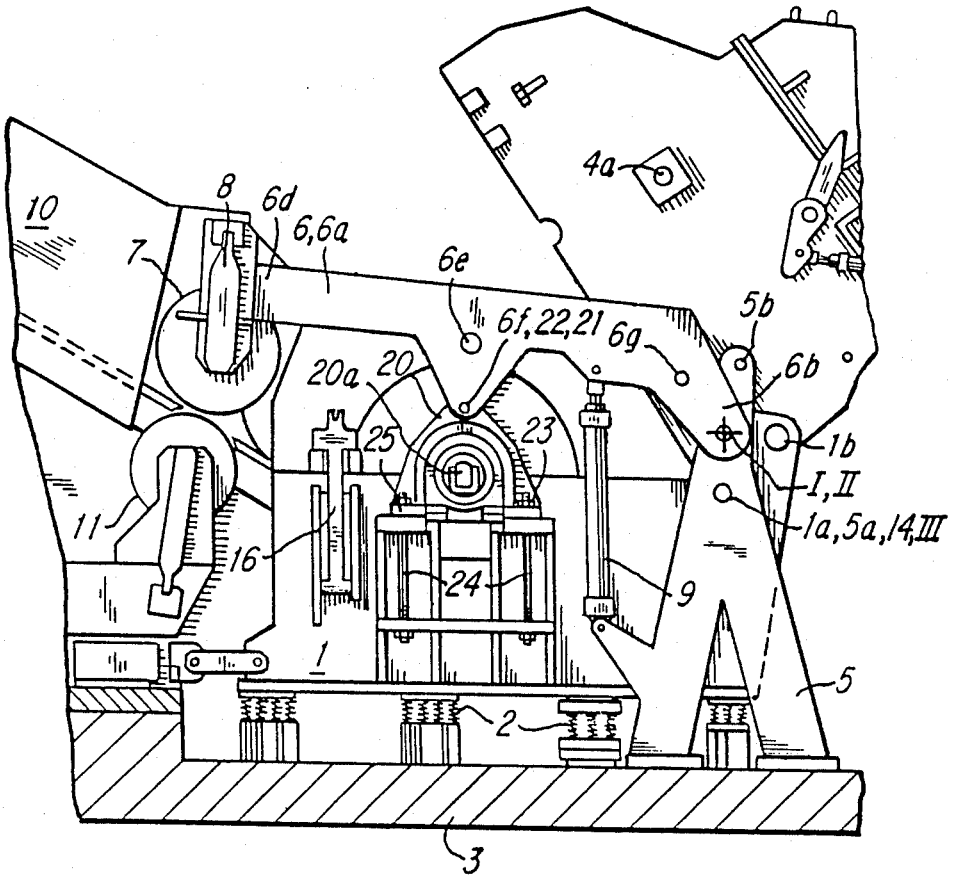
FIG. 5 is a side view similar to FIG. 1 with the upper part of the housing raised and with the mounting brackets for the rotor connected to the lifting mechanism.
Figure 6:
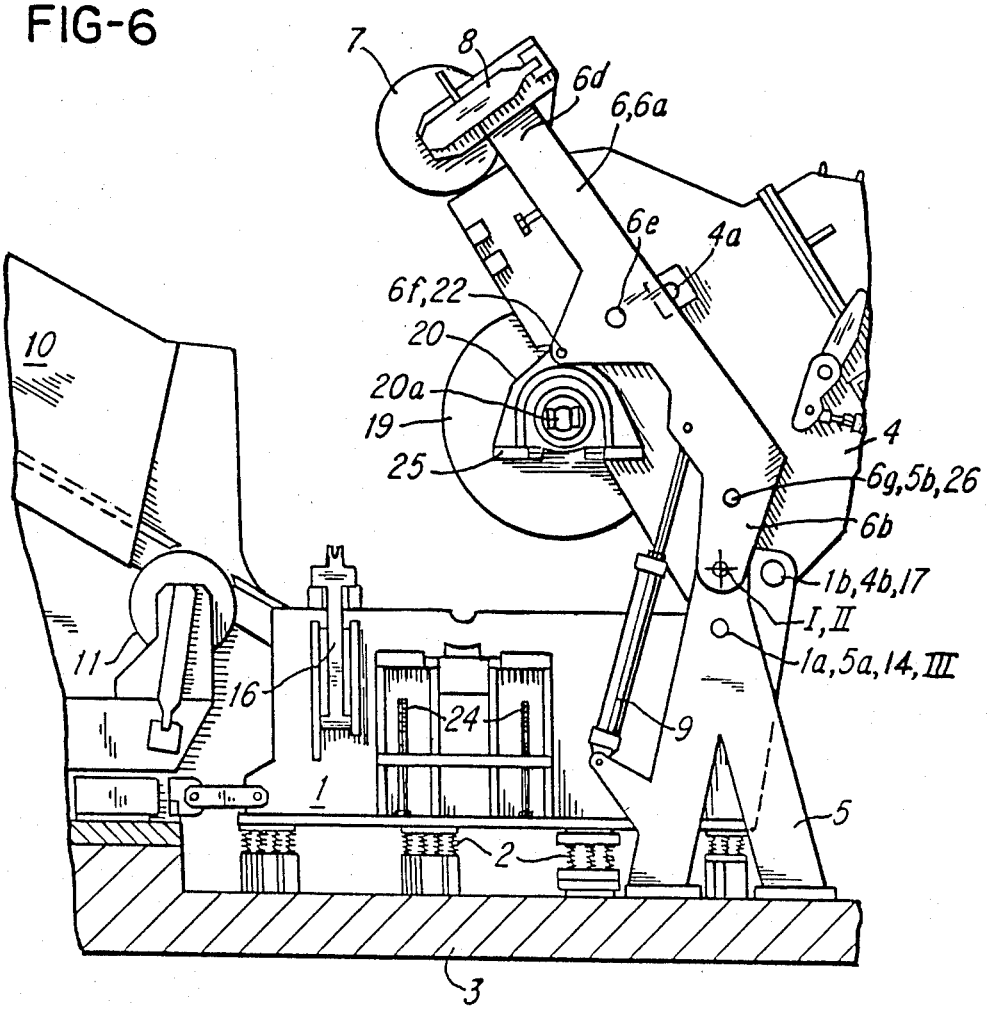
FIG. 6 is a side view similar to that of FIG. 1, with the rotor raised and the U-shaped frame of the lifting mechanism secured to the stationary supports.

To remove the rotor 19, the pin 15 is again withdrawn, so that the U-shaped frame 6 can once again be pivoted into its lowermost operating position by an appropriate activation of the hydraulic cylinder 9. This position of the U-shaped frame 6 is illustrated in FIG. 5. In this position, the opening **6*f* of the U-shaped frame 6 and the opening 21 of the mounting bracket 20 of the rotor mounting 20*a* are aligned. After a pin 22 has been introduced into the openings 6*f* and 21, and after the nuts 23 have been removed from the anchoring rods 24, with which the base 25 of the rotor mounting 20*a* is secured to the lower part 1 of the housing, the rotor 19 is raised by again activating the hydraulic cylinders 9. In FIG. 6, the rotor 19 is shown in the upper raised position. In this upper position of the U-shaped frame 6, the opening 6*g* in the side arm 6*a* and the opening 5*b* in the support 5 are aligned. Via a pin 26, the U-shaped frame 6 is positively secured relative to the support 5. In this position, the hydraulic cylinders 9** can be relieved.

To reestablish an operating readiness for the crusher, the aforementioned sequence is reversed.

The present invention is, of course, in no way restricted to the specific disclosure of the specification and drawings, but also encompasses any modifications within the scope of the appended claim.

What I claim is:

1. In a lifting mechanism for a pressing roller of a feed mechanism of a crusher for scrap, a rotor of said crusher via said lifting mechanism, which acts upon a mounting bracket of a rotor mounting, can be removed from a split housing after an upper part of said housing has been raised about a first horizontal pivot axis and has been secured in position relative to a lower part of said housing, whereby pivot arms are disposed on opposite faces of said housing and are connected to hydraulic cylinders, with free ends of said pivot arms being pivotally mounted about a second horizontal pivot axis that is substantially aligned with said first horizontal pivot axis, and whereby said pivot arms, via appropriate pins, are adapted to be successively connected with said upper part of said housing to raise same, with said mounting bracket of said rotor mounting after said upper part of said housing is secured relative to said lower part of said housing in an open position and said pivot arms have again been lowered, and again with said upper part of said housing after said pivot arms and said rotor have been raised, the improvement wherein:

said pivot arms are extended beyond said housing in a direction toward said feed mechanism and are respective side arms of a U-shaped frame having a crosspiece with an underside that supports mounting means of said pressing roller, with said free ends of said pivot arms being disposed remote from said feed mechanism with said pivot arms being mounted on supports that are respectively disposed next to, but do not touch said opposite faces of said housing, which housing is resiliently mounted, and said supports are securely connected with a base for said crusher; first pin and opening means are provided for, while second pin and opening means are provided for connecting said pivot arms to said upper part of said housing, thus permitting said upper part of said housing to be raised upon activation of said hydraulic cylinders, whereupon in this raised position third pin and opening means are provided for arresting said upper part of said housing relative to said lower part of said housing; fourth pin and opening means are provided for positively connecting said pivot arms, after said second pin and opening means have been released, with said mounting bracket of said rotor mounting, thus permitting said pivot arms and said rotor to be raised upon activation of said hydraulic cylinders, whereupon in this raised position of said pivot arms and said rotor, fifth pin and opening means are provided for positively connecting said pivot arms with supports.

* * * * *